US010768557B2

(12) United States Patent
Okamoto et al.

(10) Patent No.: US 10,768,557 B2
(45) Date of Patent: Sep. 8, 2020

(54) INTERMEDIARY TRANSFER BELT AND IMAGE FORMING APPARATUS

(71) Applicant: CANON KABUSHIKI KAISHA, Tokyo (JP)

(72) Inventors: Kaoru Okamoto, Kamagaya (JP); Kazuhisa Shirayama, Abiko (JP); Ryosuke Tsuruga, Abiko (JP); Yasutomo Tsuji, Utsunomiya (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/717,480

(22) Filed: Dec. 17, 2019

(65) Prior Publication Data

US 2020/0201209 A1 Jun. 25, 2020

(30) Foreign Application Priority Data

Dec. 20, 2018 (JP) ..... 2018-238948

(51) Int. Cl.
*G03G 15/16* (2006.01)
*G03G 15/01* (2006.01)

(52) U.S. Cl.
CPC ..... *G03G 15/162* (2013.01); *G03G 15/0131* (2013.01); *G03G 15/161* (2013.01); *G03G 15/1685* (2013.01)

(58) Field of Classification Search
CPC ..... G03G 15/1605–162
See application file for complete search history.

(56) References Cited

U.S. PATENT DOCUMENTS

| | | | | |
|---|---|---|---|---|
| 5,298,124 | A * | 3/1994 | Eklund | D21F 3/0227 162/306 |
| 9,423,727 | B2 | 8/2016 | Yoshida et al. | |
| 9,442,430 | B2 | 9/2016 | Hamana et al. | |
| 9,575,439 | B2 | 2/2017 | Tsuji | |
| 9,606,478 | B2 | 3/2017 | Tsuji | |
| 2006/0008302 | A1* | 1/2006 | Someya | G03G 15/1605 399/307 |
| 2012/0027473 | A1 | 2/2012 | Yamashita et al. | |
| 2017/0010565 | A1* | 1/2017 | Yoshida | G03G 15/162 |
| 2020/0019093 | A1 | 1/2020 | Tsuruga et al. | |

FOREIGN PATENT DOCUMENTS

| | | |
|---|---|---|
| JP | 2007-292851 | 11/2007 |
| JP | 2009-025422 | 2/2009 |
| JP | 2010-181569 | 8/2010 |
| WO | 2010/103896 | 9/2010 |

* cited by examiner

*Primary Examiner* — Carla J Therrien
(74) *Attorney, Agent, or Firm* — Venable LLP

(57) ABSTRACT

An intermediary transfer belt includes a base layer; an elastic layer laminated on or above the base layer and formed with a silicone rubber as an elastic member; an intermediary layer laminated on or above the elastic layer; and a surface layer laminated on or above the intermediary layer. The elastic layer is 60 degrees or less in JIS-A hardness and is 5 degrees or more in JIS-E hardness. The intermediary layer is 0.1 $g/m^2 \cdot 24$ h or more and 600 $g/m^2 \cdot 24$ h or less in water vapor permeability coefficient and is 1 μm or more and 15 μm or less in average thickness.

13 Claims, 1 Drawing Sheet

INTERMEDIARY TRANSFER BELT AND IMAGE FORMING APPARATUS

FIELD OF THE INVENTION AND RELATED ART

The present invention relates to an intermediary transfer belt for use with an image forming apparatus, such as a copying machine, a printer or a facsimile machine, using an electrophotographic type or an electrostatic recording type, and relates to the image forming apparatus including the intermediary transfer belt.

Conventionally, in an image forming apparatus using the electrophotographic type, an intermediary transfer type in which a toner image formed on an image bearing member such as a photosensitive member is primary-transferred onto an intermediary transfer belt which is an intermediary transfer member having an endless belt shape and then is by secondary-transferred onto a recording material such as paper has been widely used.

In such an image forming apparatus, for example, as disclosed in Japanese Laid-Open Patent Application 2007-292851, in order to further improve an image quality, an intermediary transfer belt including at least one elastic layer (hereinafter, also referred to as an "elastic intermediary transfer belt") is used in some instances. The elastic intermediary transfer belt includes at least one elastic layer, and therefore, is relatively soft, so that pressure acting on toner at transfer portions (primary transfer portion, secondary transfer portion) can be reduced. For that reason, it has been known that the elastic intermediary transfer belt has an effect on suppression of a hollow phenomenon such that a part of a toner image is not transferred. Further, the elastic intermediary transfer belt has a good adhesive property to a recording material at the secondary transfer portion. For that reason, it has been known that the elastic intermediary transfer belt has an effect of not only improving a transfer efficiency of the toner image onto general-purpose paper but also improving a transfer property of the toner image onto thick paper and a transfer property of the toner image onto a recording material, with unevenness, such as embossed paper.

In such an elastic intermediary transfer belt, from a viewpoint of durability, as an elastic member constituting an elastic layer, a silicone rubber relatively small in compression set may preferably be used. Further, for the purpose of reducing high tackiness of a surface of the elastic member, on the elastic layer, a surface layer with low tackiness is provided in some instances.

However, in the intermediary transfer belt, it has been known that a phenomenon which is called "bleed(ing)" such that low-molecular weight components, such as a plasticizer, an unreacted rubber component, an electroconductive agent component and the like, which are compounding ingredients of the elastic member constituting the elastic layer and which are contained in the elastic layer migrate to the surface of the belt occurs. When the bleeding component migrates to the surface of a surface layer of the intermediary transfer belt, the bleeding component has the influence on an image quality in some cases. Particularly, in the case where the silicone rubber is used as the elastic member constituting the elastic layer, the bleed of the low-molecular weight components contained in the elastic layer is liable to occur. Further, in the case where the silicone rubber constituting the elastic layer is further softened in order to further improve the transfer property of the toner image onto the recording material with unevenness such as the embossed paper, there is a tendency that the bleed is further liable to occur.

SUMMARY OF THE INVENTION

Accordingly, a principal object of the present invention is to provide an intermediary transfer belt capable of suppressing bleed of a component contained in an elastic layer formed of a silicone rubber as an elastic member and an image forming apparatus including the intermediary transfer belt.

According to an aspect of the present invention, there is provided an intermediary transfer belt comprising: a base layer; an elastic layer provided on or above the base layer and formed with a silicone rubber as an elastic member; an intermediary layer provided on or above the elastic layer; and a surface layer provided on or above the intermediary layer, wherein the elastic layer is 60 degrees or less in JIS-A hardness and is 5 degrees or more in JIS-E hardness, and wherein the intermediary layer is 0.1 $g/m^2 \cdot 24$ g or more and 600 $g/m^2 \cdot 24$ h or less in water vapor permeability coefficient and is 1 μm or more and 15 μm or less in average thickness.

Further features of the present invention will become apparent from the following description of exemplary embodiments with reference to the attached drawings.

DESCRIPTION OF EMBODIMENTS

Figure 1:
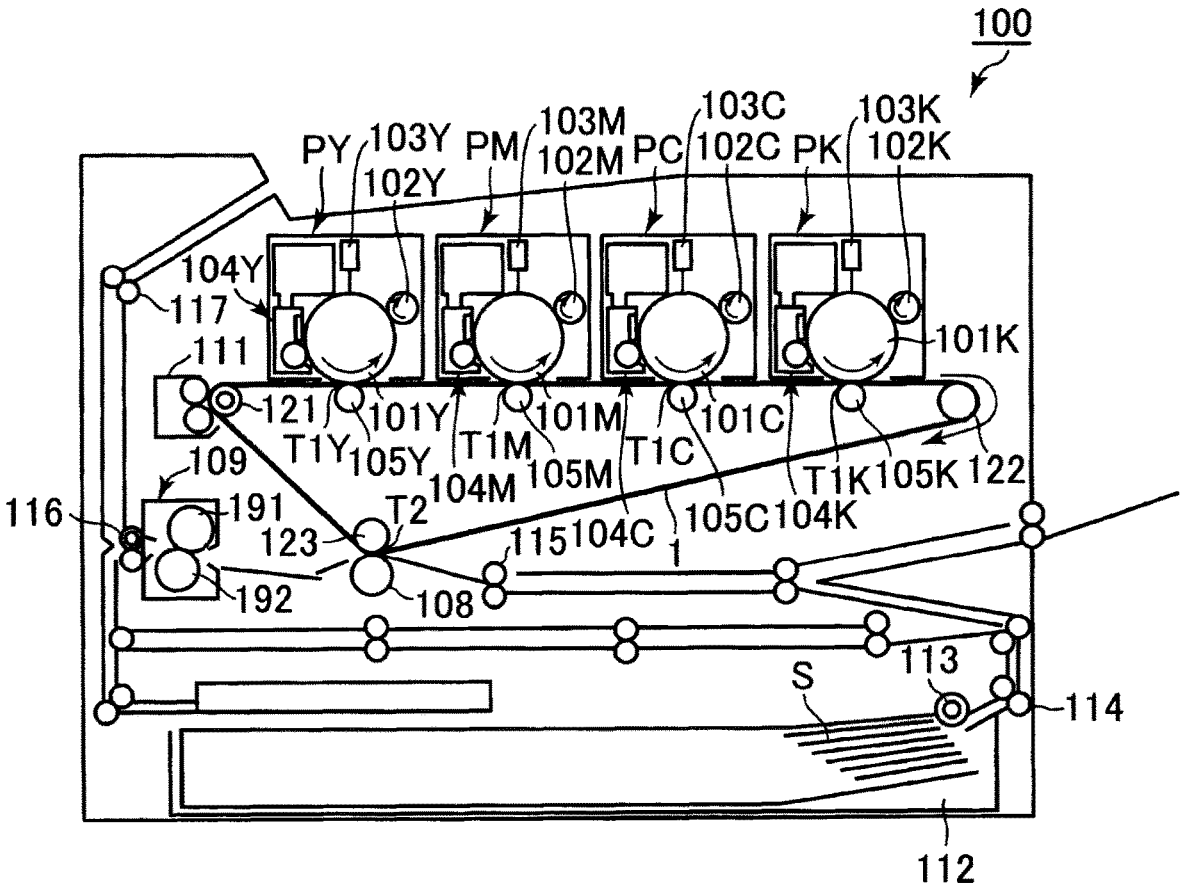
FIG. 1 is a schematic sectional view of an example of an image forming apparatus.

In the following, an intermediary transfer belt according to the present invention, and an image forming apparatus including the intermediary transfer belt will be specifically described with reference to the drawing.

1. Image Forming Apparatus

First, an embodiment of an image forming apparatus capable of using an intermediary transfer belt according to the present invention will be described. FIG. 1 is a schematic sectional view of an image forming apparatus 100 of this embodiment. The image forming apparatus 100 of this embodiment is a color laser printer of a tandem type which is capable of forming a full-color image by using an electrophotographic type and which employs an intermediary transfer type.

The image forming apparatus 100 includes four image forming portions PY, PM, PC and PK for forming images of colors of yellow (Y), magenta (M), cyan (C) and black (K), respectively, arranged along a movement direction of a flat portion of an intermediary transfer belt 1. As regards elements having the same or corresponding functions and constitutions of the respective image forming portions PY, PM, PC and PK, these elements are collectively described in some instances by omitting suffixes Y, M, C and K of reference numerals or symbols representing the elements for associated colors. In this embodiment, the image forming portion P is constituted by including a photosensitive drum 101, a charging roller 102, an exposure device 103, a developing device 104 and a primary transfer roller 105 which are described later.

The photosensitive drum 101 which is a drum-type (cylindrical) photosensitive member (electrophotographic photosensitive member) as an image bearing member is rotationally driven in the counterclockwise direction indicated by an arrow in the figure. The photosensitive drum 101 is constituted by successively laminating, on a base material formed with an aluminum cylinder, a charge generating layer, a charge transporting layer and a surface protecting layer in a named order. A surface of the rotating photosensitive drum 101 is electrically charged uniformly to a predetermined polarity (negative in this embodiment) and a predetermined potential by the charging roller 102 which is a roller-type charging member as a charging means. During a charging step, to the charging roller 102, a predetermined charging voltage (charging bias) is applied. The charged surface of the photosensitive drum 101 is subjected to scanning exposure depending on image information by the exposure device (laser scanner) 103 as an exposure means, so that an electrostatic (latent) image for a color component corresponding to an associated image forming portion P is formed on the photosensitive drum 101. The electrostatic image formed on the photosensitive drum 101 is developed (visualized) by supplying toner as a developer by the developing device 104 as a developing means. The developing device 104 includes a developing container accommodating the toner, a developing roller as a developer carrying member, a regulating blade as a developer amount regulating member for regulating an amount of the toner on the developing roller, and the like. The developing devices 104Y, 104M, 104C and 104K for yellow, magenta, cyan and black accommodate toners of the respective colors of yellow, magenta, cyan and black, respectively. The developing roller is lightly press-contacted to the photosensitive drum 101 at a developing portion, and is rotationally driven with a speed difference in the same direction as the photosensitive drum 101 at the developing portion. The toner fed to the developing portion by the developing roller is deposited on the electrostatic image formed on the photosensitive drum 101 by applying a predetermined developing voltage (developing bias) to the developing roller. In this embodiment, on an exposed portion (image portion) of the photosensitive drum 101 lowered in absolute value of a potential by being exposed to light after the photosensitive drum surface is charged uniformly, the toner charged to the same polarity (negative in this embodiment) as a charge polarity of the photosensitive drum 101 is deposited.

The intermediary transfer belt (elastic intermediary transfer belt) 1 constituted by an endless belt as an intermediary transfer member is provided so as to be contactable to the four photosensitive drum 101Y, 101M, 101C and 101K. The intermediary transfer belt 1 is extended around and stretched by, as a plurality of stretching rollers (supporting rollers), a driving roller 121, a tension roller 122, and a secondary transfer opposite roller 123 under predetermined tension. The intermediary transfer belt 1 is rotated (circulated and moved) in the clockwise direction indicated by an arrow in FIG. 1 through transmission of a driving force by rotationally driving the driving roller 121. On an inner peripheral surface side of the intermediary transfer belt 1, corresponding to an associated one of the photosensitive drums 101, the primary transfer roller 105 which is a roller-type primary transfer member as a primary transfer means is disposed. The primary transfer roller 105 is pressed toward the photosensitive drum 101 via the intermediary transfer belt 1, so that a primary transfer portion (primary transfer nip) T1 where the photosensitive drum 101 and the intermediary transfer belt 1 contact each other is formed. As described above, the toner image formed on the photosensitive drum 101 is primary-transferred onto the rotating intermediary transfer belt 1 by the action of the primary transfer roller 105 at the primary transfer portion T1. During a primary transfer step, to the primary transfer roller 105, a predetermined primary transfer voltage (primary transfer bias) which is a DC voltage of an opposite polarity to a normal charge polarity (charge polarity during the development) of the toner is applied. For example, during full-color image formation, the toner images of the respective colors of yellow, magenta, cyan and black formed on the photosensitive drums 101Y, 101M, 101C and 101K are successively primary-transferred superposedly onto the intermediary transfer belt 1.

On an outer peripheral surface side of the intermediary transfer belt 1, at a position opposing the secondary transfer opposite roller 123, a secondary transfer roller 108 which is a roller-type secondary transfer member as a secondary transfer means is disposed. The secondary transfer roller 108 is pressed toward the secondary transfer opposite roller 123 via the intermediary transfer belt 1, so that a secondary transfer portion T2 where the intermediary transfer belt 1 and the secondary transfer roller 108 contact each other is formed. As described above, the toner image formed on the intermediary transfer belt 1 is secondary transferred onto a recording material S such as paper (sheet) sandwiched and fed between the intermediary transfer belt 1 and the secondary transfer roller 108 by the action of the secondary transfer roller 108 at the secondary transfer portion T2. During a secondary transfer step, to the secondary transfer roller 108, a predetermined secondary transfer voltage (secondary transfer bias) which is the DC voltage of the opposite polarity to the normal charge polarity of the toner is applied. In general, in order to ensure sufficient transfer efficiency, a transfer voltage of several kV is applied. The recording material (recording medium, transfer-receiving material sheet) S is accommodated in a cassette 112 and is supplied from the cassette 12 toward a feeding passage by a pick-up roller 113. The recording material S supplied to the feeding passage is fed to the secondary transfer portion T2 by a feeding roller pair 114 and a registration roller pair 115 while being timed to the toner image on the intermediary transfer belt 1. The recording material S is typically the paper (sheet), but may also be synthetic paper such as waterproof paper formed of a resin material, a plastic sheet such as an OHP sheet, a cloth, or the like.

The recording material S on which the toner image is transferred is conveyed to a fixing device 109 as a fixing means. The fixing device 109 includes a fixing roller 191 provided with a heating means and a pressing roller 192 press-contacted to the fixing roller 191. By the fixing roller 191 and the pressing roller 192, the fixing device 109 heats and presses the recording material S carrying thereon an unfixed toner image and fixes (melts, sticks) the toner image on the recording material S. The recording material S on which the toner image is fixed is discharged (outputted) to an outside of an apparatus main assembly of the image forming apparatus 100 by a conveying roller pair 116, a discharging roller pair 117 and the like.

Toner remaining on the surface of the photosensitive drum 101 without being transferred onto the intermediary transfer belt 1 during the primary transfer step is removed and collected from the photosensitive drum 101 by the developing device 104 in this embodiment. Further, toner (secondary transfer residual toner) and paper dust which remain on the surface of the intermediary transfer belt 1 without being transferred onto the recording material S during the secondary transfer step is removed and collected from the surface of the intermediary transfer belt 1 by a belt cleaning device 11 as an intermediary transfer member cleaning means.

As the intermediary transfer belt 1 in such an image forming apparatus 100, by using the intermediary transfer belt 1 according to the present invention, migration of a bleed component generated from an elastic layer 12 (FIG. 2) to the surface of the intermediary transfer belt 1 is suppressed. As a result, a high-quality image can be formed.

2. Intermediary Transfer Belt

Figure 2:
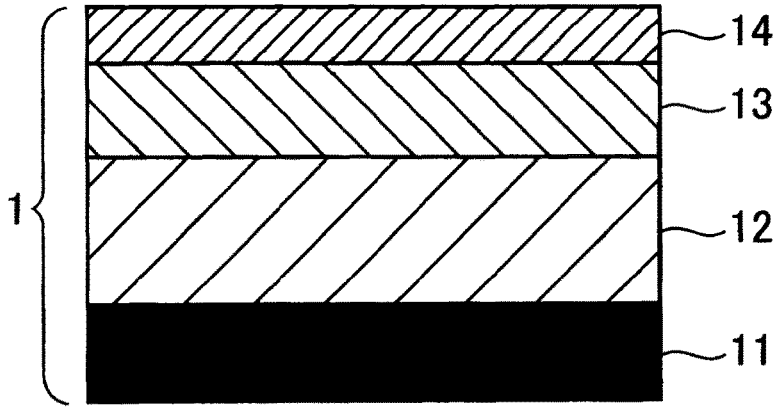
FIG. 2 is a schematic sectional views of an intermediary transfer belt.

Next, an embodiment of the intermediary transfer belt (elastic intermediary transfer belt) 1 according to the present invention will be described. As shown in FIG. 2, the intermediary transfer belt 1 of this embodiment is constituted by a lamination member including four layers consisting of a base layer 11, the elastic layer 12, an intermediary layer 13 and a surface layer 14.

<Base Layer>

The base layer (base material) 11 will be described. The base layer 11 has a cylindrical form of a seamless type such as a roller shape or a belt shape. As a material suitable for constituting the base layer 11, it is possible to cite resin materials, such as polyether ether ketone, polyethylene terephthalate, polybutylene naphthate, polyester, polyimide, polyamide, polyamideimide, polyacetal, polyphenylene sulfide, and the like.

Incidentally, to the resin material constituting the base layer 11, electroconductivity may also be imported by adding electroconductive powder such as metal powder, electroconductive powder, electroconductive carbon (black) or the like.

As the resin material constituting the base layer 11, from viewpoints of mechanical strength and electroconductivity, polyether ether ketone or polyimide, to which carbon black is added may particularly be preferred.

A thickness (film thickness) of the base layer 11 may preferably be 10 μm or more and 500 μm or less. When the thickness of the base layer 11 is less than 10 μm, the mechanical strength remarkably lowers in some cases. Further, when the thickness of the base layer 11 is larger than 500 μm, rigidity becomes excessively strong, and therefore, in some cases it becomes difficult to use the intermediary transfer belt 1 as an intermediary transfer member because the rigidity becomes excessively strong.

<Elastic Layer>

The elastic layer 12 will be described. There is a need that the elastic layer 12 possesses appropriate flexibility in order to follow a surface shape of the recording material S. In the present invention, as a material of the elastic member constituting the elastic layer 12, from viewpoints that compression set is small and that ozone resistance is excellent, a silicone rubber is used.

The thickness of the elastic layer 12 may preferably be 100 μm or more and 1000 μm or less, more preferably be 200 μm or more and 500 μm or less. When the thickness of the elastic layer 12 is excessively thin, sufficient flexibility cannot be obtained in some cases, and when the thickness of the elastic layer 12 is excessively thick, the resultant intermediary transfer member increases in weight as a whole, so that inconveniences such that the image forming apparatus is upsized and becomes expensive are caused. Further, as described later specifically, there is need that the elastic layer 12 is 60 degrees or less in JIS-A hardness and is 5 degrees or more in JIS-E hardness. Further, the elastic layer 12 may preferably be 55 degrees or less in JIS-A hardness and be 10 degrees or more in JIS-E hardness. When the JIS-E hardness is excessively low, bleed is liable to occur, and when the JIS-A hardness is excessively high, a transfer property of toner (toner image) onto the recording material S with unevenness lowers in some instances.

The elastic layer 12 may also contain an electron conductive agent or an ion conductive agent as an electroconductive agent. As the electron conductive agent, it is possible to cite electroconductive carbon black such as acetylene or Ketjen black, graphite, graphene, carbon fiber, carbon nanotube, and the like. Further, as the electron conductive agent, it is possible to cite metal powder such as silver, copper or nickel, electroconductive zinc white (oxide), electroconductive calcium carbonate, electroconductive titanium oxide, electroconductive tin oxide, electroconductive mica, and the like. Of these, from a viewpoint of ease of control of electric resistance, electroconductive carbon black may preferably be used. As the ion conductive agent, in addition to lithium salts or potassium salts, it is possible to cite ionic liquids of pyridine-based, alicyclic amine-based, and aliphatic amine-based, and the like. Of these materials, from viewpoints of environmental stability and suppression of polarization due to durability, the ionic liquid is preferred. Formulation of the elastic layer 12 may preferably be from a viewpoint of mechanical strength, such that 35 weight parts or less of the electroconductive agent is contained in 100 weight parts of the silicone rubber, preferably 25 weight parts or less of the electroconductive agent is contained in 100 weight parts of the silicone rubber. As a result, stable electroconductivility suitable for the intermediary transfer member is imparted to the elastic layer 12.

Further, the elastic layer 12 may also contain additives such as a filler, a cross-linking promoter, a cross-linking retarder, a cross-linking aid, a scorch retarder, an antioxidant, a softener, a heat stabilizer, a fire retardant, an auxiliary five retardant, an ultraviolet absorber, an anti-corrosive agent, and the like. Particularly, as the filler, it is possible to cite a reinforcing filler such as fumed silica, crystalline silica, wet silica, fumed titanium oxide, cellulose nanofiber, and the like. The reinforcing filler may also be surface-modified, from a viewpoint such that the reinforcing filler is easily dispersed in the silicone rubber, by an organosilicone compound such as organoalkoxysilane, organohalosilane, organosilazane, diorganosiloxane oligomer of which terminals are blocked with silanol group, or cyclic organosiloxane.

Incidentally, between the base layer 11 and the elastic layer 12, a primer layer (not shown) may also be provided as desired. A thickness of the primer layer may preferably be 0.1 μm or more and 0.3 μm or less from a viewpoint that cohesive failure in the primer layer is reduced.

<Intermediary Layer>

The intermediary layer 13 while described. The intermediary layer 13 is set so that water vapor permeability coefficient is decreased in order to suppress bleed, to a surface of the surface layer 14, of a low-molecular weight component generated in the elastic layer 12. As a material of the intermediary layer 13, when a material is 600 $g/m^2 \cdot 24$ h or less in water vapor permeability coefficient in the case where a thickness of the intermediary layer 13 is 15 μm, the material can be used with no particular limitation. As such a material, it is possible to cite polyurethane (urethane resin), polyamide resin, polyvinylidene chloride resin, fluorine-containing resin, phenolic resin, cellulose acetate resin, and the like.

The thickness of the intermediary layer 13 may preferably be 0.8 μm or more and 16 μm or less, more preferably be 1 μm or more and 15 μm or less. When the thickness of the intermediary layer 13 is excessively thin, a region where the bleed cannot be locally suppressed stably generates in some cases. Further, when the thickness of the intermediary layer 13 is excessively thick, an elastic function of the elastic layer 12 is impaired in some cases.

The intermediary layer 13 may contain additives such as a hardener, a plasticizer, an electroconductive agent, as desired. An amount of the additives is not particularly limited when the amount is to the extent that the water vapor permeability coefficient is not impaired and falls within a range in which sufficient mechanical strength is ensured.

<Surface Layer>

The surface layer 14 will be described. The surface layer 14 constitutes a surface (toner image carrying surface) of the intermediary transfer belt 1. The surface layer 14 is a layer provided for improving a transfer property of the toner (toner image) onto the recording material S and improving a parting property of the toner from the intermediary transfer belt 1, and is required to have low adherence. As a material of the surface layer 14, when a material has the low adherence, the material can be used with no particular limitation. As such a material, it is possible to cite fluorine-containing resin, fluorine-containing urethane resin, fluorine-containing rubber, siloxane-modified polyimide, and the like. Of these, from a viewpoint that the elastic function of the elastic layer 12 is not impaired, the fluorine-containing urethane resin is preferred. Further, in these resins, hydrophobic filler such as PTFA particles, PFPE particles, PFA particles, Si particles and hydrophobized $SiO_2$ particles may also be added.

A thickness of the surface layer 14 may preferably be 1 μm or more and 4 μm or less. When the thickness of the surface layer 14 is less than 1 μm, the surface layer 14 is liable to disappear due to abrasion. Further, when the thickness of the surface layer 14 is larger than 4 μm, the elastic function of the elastic layer 12 is impaired in some cases.

The surface layer 14 may also contain an electroconductive agent similar to those described above, as desired. As regards an amount of the electroconductive agent, from viewpoints of adherence and mechanical strength, the amount may preferably be 30 in which parts or less per 100 weight parts of a main component (fluorine-containing urethane resin or the like) of the surface layer 14.

<Electric Resistance of Intermediary Transfer Belt>

Volume resistivity of the intermediary transfer belt 1 may preferably be $1.0\times10^{6}$ Ω·cm or more and $1.0\times10^{14}$ Ω·cm or less, more preferably be $1.0\times10^{8}$ Ω·cm or more and $1.0\times10^{13}$ Ω·cm or less.

Surface resistivity of the intermediary transfer belt 1 measured from the surface layer 14 side may preferably be $1.0\times10^{6}$ Ω/sq. or more and $1.0\times10^{14}$ Ω/sq. or less, more preferably $1.0\times10^{9}$ Ω/sq. or more and $1.0\times10^{13}$ Ω/sq. or less.

By setting the electric resistance of the intermediary transfer belt 1 within semiconductive region ranges as described above, it is possible to stably carry out primary transfer of the toner image from the photosensitive drum 101 onto the intermediary transfer belt 1 and secondary transfer of the toner image from the intermediary transfer belt 1 onto the recording material S.

3-1. Structures of Intermediary Transfer Belts in Embodiments and Comparison Examples.

Next, an effect of the present invention will be further described based on the following embodiments 1 to 14 and comparison examples 1 to 4.

<Measuring Method of Thicknesses of Respective Layers>

Here, a measuring method of thicknesses of the respective layers will be described. The thicknesses of the respective layers (base layer 11, elastic layer 12, intermediary layer 13 and surface layer 14) of the intermediary transfer belt 1 were obtained by preparing a cross-sectional portion perpendicular to the intermediary transfer belt surface from the surface of the intermediary transfer belt 1 by using a cross-section polisher and then by observing the prepared cross-sectional portion with a scanning electron microscope.

Specifically, by a cross-section polisher (trade name: "SM-09010", manufactured by JEOL, Ltd.), a cross-sectional portion perpendicular to the intermediary transfer belt surface was prepared with argon gas in 15 hours under a condition of an accelerated voltage of 4 kV and a current value of 70 μA. Thereafter, this cross-sectional portion was observed at arbitrary three points through a scanning electron microscope (trade name: "XL-300-SFEG", manufactured by FEI Co.) under a condition of an accelerated voltage of 3 kV and a magnification of 1500, and a thickness of each of layers was calculated from resultant image data, and then an average of the calculated thicknesses was taken as a thickness (average thickness, average film thickness) of each of layers as an object to be evaluated.

Embodiment 1

In the following embodiments and comparison examples, as materials (ingredients) of a mixture dispersion, those diluted and dispersed in solvents are used, but amounts (weight parts) of use of respective materials are those of nonvolatile components unless otherwise specified, and mean amounts from which the solvents are removed.

<Preparation of Base Layer>

The following materials were kneaded using a biaxial kneader (trade name: "PCM 30", manufactured by Ikegai Corp.), so that a pellet was obtained.

Polyether ether ketone (trade name: "VICTREX PEEK450G", Victrex Japan Inc.)

Acetylene black (trade name: "DENKA BLACK (Granular)", manufactured by Denka Co., Ltd.)

The above materials were charged into the biaxial kneader using weight feeders so that 80 weight % of the polyether ether ketone and 20 weight % of the acetylene black were mixed. A cylinder set temperature of the biaxial kneader was 320° C. at a material charging portion and was 360° C. at a downstream portion of the cylinder and a die. A screw rotation number of the biaxial kneader was 300 rpm, and a material charging rate was 8 kg/h.

Then, using a resultant pellet, a belt was obtained by subjecting the pellet to cylindrical extrusion molding. The cylindrical extrusion molding was carried out using a single screw extruder (trade name: "GT40", manufactured by Research Laboratory of Plastics Technology Co., Ltd.) and a cylindrical die of 300 mm in diameter and 1 mm in cylindrical opening. Using the weight feeder, the pellet was fed to the single screw extruder at a feeding amount (rate) of 4 kg/h. The cylinder set temperature of the single screw extruder was 320° C. at the material charging portion and was 380° C. at the downstream portion of the cylinder and at the cylindrical die. A melted resin material extruded from the single screw extruder was extruded through the cylindrical die via a gear pump and then was drawn by a cylindrical drawing machine at a speed providing a thickness of 85 μm. The melted resin material was cooled and solidified in a drawn process by being contacted to a cooling mandrel provided between the cylindrical die and the cylindrical drawing machine. The solidified resin material was cut to provide a width of 460 mm by a cylindrical cutting machine provided at a lower portion of the cylindrical drawing machine, so that a crystalline thermoplastic resin belt was obtained.

<Preparation of Elastic Layer>

As the electroconductive agent, an ionic liquid anti-static agent (trade name: "FC-4400", manufactured by 3M Japan Ltd.) was used. Into 100 weight parts of an addition-curable liquid silicone rubber (trade name: "TSE3032 AB" (weight ratio, A:B=100:10), manufactured by Momentive Performance Materials Inc.) 0.2 weight part of the above-prepared electroconductive agent was added, followed by stirring and deaeration by a planetary stirring deaerating apparatus (trade name: "HM-500", manufactured by KEYENCE Corp.), so that a mixture was obtained.

Next, the above-prepared crystalline thermoplastic resin belt as the base layer 11 was mounted on a cylindrical core, and a ring nozzle for rubber ejection was mounted coaxially with the core. The above-prepared liquid silicone rubber mixture was fed to the ring nozzle by using a liquid feeding pump and was ejected through a slit, so that the mixture was applied onto the base layer 11. At this time, a relative moving speed of the ring nozzle and an ejection amount (rate) of the liquid feeding pump were adjusted so that the thickness of the silicone rubber layer after curing was 220 μm.

The crystalline thermoplastic resin belt on which the above-described mixture was applied was placed in a heating furnace in a state in which the crystalline thermoplastic resin belt was mounted on the core. A step of cross-linking (vulcanization) in the heating furnace was performed by heating the resin belt at 130° C. for 10 min. as primary baking and at 180° for 180 min, as secondary baking, so that rubber cross-linking was performed. After cooling, the belt was dismounted from the core, and the belt on which the elastic layer 12 was laminated was obtained.

<Surface Modification of Elastic Layer>

In order to improve an adhesive property between the elastic layer 12 and the intermediary layer 13, surface modification of the elastic layer 12 was performed using an excimer lamp (manufactured by M. D. COM. Inc.), emitting UV radiation of 172 nm in single wavelength as an excimer UV irradiation unit.

The belt on which the elastic layer 12 was laminated was engaged on a cylindrical core and was disposed at a position with a distance of about 1 m from a surface of the excimer lamp, and then excimer UV irradiation was carried out for 30 min. in a space in which nitrogen gas and the air were filled while rotating the core at a rotational speed of 5 rpm.

As a result, on the surface of the elastic layer 12 at the intermediary layer side, a surface modifying layer, which is $SiO_2$ layer principally comprising $SiO_2$, formed by irradiating the elastic layer 12 with excimer UV radiation is provided.

<Preparation of Intermediary Layer>

As a material of the intermediary layer 13, polyurethane resin paint (trade name: "Hydran 201", manufactured by DIC Corp.) was used. The belt on which the surface-modified elastic layer 12 was laminated was engaged on the core, and the polyurethane resin paint was applied onto the surface of the elastic layer 12 by using a spray gun (trade name: "W-101", manufactured by ANEST IWATA Corp.) while rotating the core at a rotational speed of 90 rpm. An ejection amount (rate) of the paint during application was set so that a thickness of the intermediary layer 13 after drying is 8 μm.

After application of the resin paint, in a state in which the resultant belt was engaged on the core, the belt was air-dried for 15 min. while rotating the core at the rotational speed of 90 rpm. After drying, the belt on which the polyurethane intermediary layer 13 was laminated on the elastic layer 12 was obtained.

<Preparation of Surface Layer>

As a material of the surface layer 14, a fluorine-containing polyurethane resin liquid in which polytetrafluoroethylene was dispersed in a polyurethane dispersion (trade name: "Emralon T-861", manufactured by Henkel Japan Ltd.). The above-prepared belt on which the intermediary layer 13 was laminated was engaged on the core, and the polyurethane resin paint was applied onto the surface of the intermediary layer 13 by using the spray gun (trade name: "W-101", manufactured by ANEST IWATA Corp.) while rotating the core at the rotational speed of 90 rpm. An ejection amount (rate) of the during application was set so that a thickness of the surface layer 14 after drying is 3 μm.

After the application of the resin paint, the resultant belt was placed in a heating furnace of 130° C. and then was left standing for 30 min. Thereafter, the belt was taken out of the heating furnace followed by cooling, so that an intermediary transfer belt 1 of the embodiment 1 was obtained.

<Thickness>

As regards the thicknesses of the respective layers of the intermediary transfer belt 1 of the embodiment 1, the base layer 11 was 85 μm, the elastic layer 12 was 220 μm, the intermediary layer 13 was 8.0 μm, and the surface layer 14 was 3.0 μm.

Embodiment 2

An intermediary transfer belt 1 of an embodiment 2 was prepared in the same manner as in the embodiment 1 except for the following change.

<Change>

In the preparation of the elastic layer 12, as the electroconductive agent of the elastic layer 12, an ionic group-containing silicone oligomer (trade name: "X-40-2750", manufactured by Shin-Etsu Chemical Co., Ltd.) was added in an amount of 0.2 weight part per 100 weight parts of an addition-curable liquid silicone rubbers.

Further, in the preparation of the intermediary layer 13, as the material of the intermediary layer 13, a polyamide resin material (trade name: "AQ Nylon P70", manufactured by Toray Industries, Inc.) was used. Polyamide resin paint was obtained by preparing a solution of 15 weight % of a pellet-shaped polyamide resin material ("AQ Nylon P70") in ethanol and then by adding 20 weight parts of a curing agent (trade name: "RESITOP 2773", manufactured by Gunei Chemical Industry Co., Ltd.) in the solution with respect to the resin material, and then by adding ethanol so that a total solid content was 10 weight %. The thus-prepared polyamide resin paint was spray-applied onto the elastic layer 12 so that a thickness of the intermediary layer 13 after drying was 6 μm. Thereafter, in a state in which the resultant belt was engaged on the core, the belt was dried for about 10 min. while rotating the core at the rotational speed of 90 rpm, so that the solvent was sufficiently removed by drying. Thereafter, the belt was heated and baked at 150° C. for 30 min. in the heating furnace while engaging the belt on the core. Then, the belt engaged on the core was taken out of the heating furnace and was sufficiently cooled, so that the belt on which the polyamide intermediary layer 13 was laminated on the elastic layer 12 was obtained.

<Thickness>

As regards the thicknesses of the respective layers of the intermediary transfer belt 1 of the embodiment 2, the base layer 11 was 85 μm, the elastic layer 12 was 220 μm, the intermediary layer 13 was 6.0 μm, and the surface layer 14 was 3.0 μm.

Embodiment 3

An intermediary transfer belt 1 of an embodiment 3 was prepared in the same manner as in the embodiment 1 except for the following change.

<Change>

In the preparation of the intermediary layer 13, as the material of the intermediary layer 13, a polyvinylidene chloride resin material (trade name: "Saran Resin F310", manufactured by Asahi Kasei Corp.) was used. Polyvinylidene chloride resin paint was obtained by preparing a solution of 20 weight % of a solid polyvinylidene chloride resin material ("Saran Resin F310") in methyl ethyl ketone and then by adding 20 weight parts of a curing agent (trade name: "Aliphatic Dibasic Acid Ester DBS", manufactured by Daihachi Chemical Industry Co., Ltd.) in the solution with respect to the resin material, and then by adding methyl ethyl ketone so that a total solid content was 15 weight %. The thus-prepared polyvinylidene chloride resin paint was spray-applied onto the elastic layer 12 so that a thickness of the intermediary layer 13 after drying was 2 μm. Thereafter, in a state in which the resultant belt was engaged on the core, the belt was dried for about 10 min. while rotating the core at the rotational speed of 90 rpm, so that the solvent was sufficiently removed by drying. Thereafter, the belt was heated and baked at 100° C. for 30 min. in the baking furnace while engaging the belt on the core. Then, the belt engaged on the core was taken out of the heating furnace and was sufficiently cooled, so that the belt on which the polyvinylidene chloride resin intermediary layer 13 was laminated on the elastic layer 12 was obtained.

<Thickness>

As regards the thicknesses of the respective layers of the intermediary transfer belt 1 of the embodiment 3, the base layer 11 was 85 μm, the elastic layer 12 was 220 μm, the intermediary layer 13 was 2.0 μm, and the surface layer 14 was 3.0 μm.

Embodiment 4

An intermediary transfer belt 1 of an embodiment 4 was prepared in the same manner as in the embodiment 1 except for the following change.

<Change>

In the preparation of the intermediary layer 13, as the material of the intermediary layer 13, a fluorine-containing resin material (trade name: "LUMIFLON LF600X", manufactured by AGC Inc.) was used. Fluorine-containing resin paint was obtained by adding, to the fluorine-containing resin material ("LUMIFLON LF600X"), a curing agent (trade name: "Caronate HX", manufactured by Tosoh Corp.) and toluene so that a total solid content was 20 weight %. Incidentally, an addition amount of the curing agent was adjusted so that NCO % of Coronate HX and an OH value (mgKOH/g-polymer) of LUMIFLON LF600X is NCO/OH=1. The thus-prepared fluorine-containing resin paint was spray-applied onto the elastic layer 12 so that a thickness of the intermediary layer 13 after drying was 1.6 μm. Thereafter, in a state in which the resultant belt was engaged on the core, the belt was dried for about 10 min. while rotating the core at the rotational speed of 90 rpm, so that the solvent was sufficiently removed by drying. Thereafter, the belt was heated and baked at 80° C. for 30 min. in the baking furnace while engaging the belt on the core. Then, the belt engaged on the core was taken out of the heating furnace and was sufficiently cooled, so that the belt on which the fluorine-containing resin intermediary layer 13 was laminated on the elastic layer 12 was obtained.

<Thickness>

As regards the thicknesses of the respective layers of the intermediary transfer belt 1 of the embodiment 4, the base layer 11 was 85 μm, the elastic layer 12 was 220 μm, the intermediary layer 13 was 1.6 μm, and the surface layer 14 was 3.0 μm.

Embodiment 5

An intermediary transfer belt 1 of an embodiment 5 was prepared in the same manner as in the embodiment 1 except for the following change.

<Change>

In the preparation of the intermediary layer 13, as the material of the intermediary layer 13, a phenolic resin material (trade name: "PHENOLITE 5010", manufactured by DIC Corp.) was used. Phenolic resin paint was obtained by adding and dissolving the phenolic resin material ("PHENOLITE 5010") in ethanol so that a total solid content was 20 weight %. The thus-prepared phenolic resin paint was spray-applied onto the elastic layer 12 so that a thickness of the intermediary layer 13 after drying was 15 Thereafter, in a state in which the resultant belt was engaged on the core, the belt was dried for about 10 min. while rotating the core at the rotational speed of 90 rpm, so that the solvent was sufficiently removed by drying. Thereafter, the belt was heated and baked at 160° C. for 30 min. in the baking furnace while engaging the belt on the core. Then, the belt engaged on the core was taken out of the heating furnace and was sufficiently cooled, so that the belt on which the phenolic resin intermediary layer 13 was laminated on the elastic layer 12 was obtained.

<Thickness>

As regards the thicknesses of the respective layers of the intermediary transfer belt 1 of the embodiment 5, the base layer 11 was 85 μm, the elastic layer 12 was 220 μm, the intermediary layer 13 was 15.0 and the surface layer 14 was 3.0 μm.

Embodiment 6

An intermediary transfer belt 1 of an embodiment 6 was prepared in the same manner as in the embodiment 1 except for the following change.

<Change>

In the preparation of the intermediary layer 13, as the material of the intermediary layer 13, a cellulose acetate resin material (trade name: "L-20", manufactured by Daisel Corp.) was used. Cellulose acetate paint was obtained by adding and dissolving powdery cellulose acetate ("L-20") in methyl ethyl ketone so that a total solid content was 5 weight %. The thus-prepared cellulose acetate resin paint was spray-applied onto the elastic layer 12 so that a thickness of the intermediary layer 13 after drying was 16 μm. Thereafter, in a state in which the resultant belt was engaged on the core, the belt was dried for about 15 min. while rotating the core at the rotational speed of 90 rpm, so that the solvent was sufficiently removed by drying. Thereafter, the belt was heated and baked at 60° C. for 30 min. in the baking furnace while engaging the belt on the core. Then, the belt engaged on the core was taken out of the heating furnace and was sufficiently cooled and taken out of the core, so that the belt on which the cellulose acetate resin intermediary layer 13 was laminated on the elastic layer 12 was obtained.

<Thickness>

As regards the thicknesses of the respective layers of the intermediary transfer belt 1 of the embodiment 6, the base layer 11 was 85 μm, the elastic layer 12 was 220 μm, the intermediary layer 13 was 16.0 μm, and the surface layer 14 was 3.0 μm.

Embodiment 7

An intermediary transfer belt 1 of an embodiment 7 was prepared, in the same manner as in the embodiment 1 except for the following change.

<Change>

In the preparation of the intermediary layer 13, the ejection amount (rate) of the paint of the intermediary layer 13 during application was set so that the thickness of the intermediary layer 13 after drying was 4 μm.

<Thickness>

As regards the thicknesses of the respective layers of the intermediary transfer belt 1 of the embodiment 7, the base layer 11 was 85 μm, the elastic layer 12 was 220 μm, the intermediary layer 13 was 4.0 μm, and the surface layer 14 was 3.0 μm.

Embodiment 8

An intermediary transfer belt 1 of an embodiment 8 was prepared, in the same manner as in the embodiment 2 except for the following change.

<Change>

In the preparation of the intermediary layer 13, the ejection amount (rate) of the paint of the intermediary layer 13 during application was set so that the thickness of the intermediary layer 13 after drying was 3 μm.

<Thickness>

As regards the thicknesses of the respective layers of the intermediary transfer belt 1 of the belt 8, the base layer 11 was 85 μm, the elastic layer 12 was 220 μm, the intermediary layer 13 was 3.0 μm, and the surface layer 14 was 3.0 μm.

Embodiment 9

An intermediary transfer belt 1 of an embodiment 9 was prepared, in the same manner as in the embodiment 3 except for the following change.

<Change>

In the preparation of the intermediary layer 13, the ejection amount (rate) of the paint of the intermediary layer 13 during application was set so that the thickness of the intermediary layer 13 after drying was 1 μm.

<Thickness>

As regards the thicknesses of the respective layers of the intermediary transfer belt 1 of the belt 9, the base layer 11 was 85 μm, the elastic layer 12 was 220 μm, the intermediary layer 13 was 1.0 μm, and the surface layer 14 was 3.0 μm.

Embodiment 10

An intermediary transfer belt 1 of an embodiment 10 was prepared, in the same manner as in the embodiment 4 except for the following change.

<Change>

In the preparation of the intermediary layer 13, the ejection amount (rate) of the paint of the intermediary layer 13 during application was set so that the thickness of the intermediary layer 13 after drying was 0.8 μm.

<Thickness>

As regards the thicknesses of the respective layers of the intermediary transfer belt 1 of the belt 10, the base layer 11 was 85 μm, the elastic layer 12 was 220 μm, the intermediary layer 13 was 0.8 μm, and the surface layer 14 was 3.0 μm.

Embodiment 11

An intermediary transfer belt 1 of an embodiment 11 was prepared, in the same manner as in the embodiment 1 except for the following change.

<Change>

In the preparation of the intermediary layer 13, the ejection amount (rate) of the paint of the intermediary layer 13 during application was set so that the thickness of the intermediary layer 13 after drying was 7.5 μm.

<Thickness>

As regards the thicknesses of the respective layers of the intermediary transfer belt 1 of the belt 11, the base layer 11 was 85 μm, the elastic layer 12 was 220 μm, the intermediary layer 13 was 7.5 μm, and the surface layer 14 was 3.0 μm.

Embodiment 12

An intermediary transfer belt 1 of an embodiment 12 was prepared, in the same manner as in the embodiment 6 except for the following change.

<Change>

In the preparation of the intermediary layer 13, the ejection amount (rate) of the paint of the intermediary layer 13 during application was set so that the thickness of the intermediary layer 13 after drying was 8 μm.

<Thickness>

As regards the thicknesses of the respective layers of the intermediary transfer belt 1 of the belt 12, the base layer 11 was 85 μm, the elastic layer 12 was 220 μm, the intermediary layer 13 was 8.0 and the surface layer 14 was 3.0 μm.

Embodiment 13

An intermediary transfer belt 1 of an embodiment 13 was prepared in the same manner as in the embodiment 7 except for the following change.

<Change>

In the preparation of the elastic layer 12, as the rubber material of the elastic layer 12, an addition-curable liquid silicone rubber (trade name: "TSE3032 AB" (weight ratio, A:B=1000:5), manufactured by Momentive Performance Materials Inc.) lower in cross-linking point density than the addition-curable liquid silicone rubber used in the embodiment 7 was used.

<Thickness>

As regards the thicknesses of the respective layers of the intermediary transfer belt 1 of the embodiment 13, the base layer 11 was 85 μm, the elastic layer 12 was 220 μm, the intermediary layer 13 was 4.0 μm, and the surface layer 14 was 3.0 μm.

Embodiment 14

An intermediary transfer belt 1 of an embodiment 14 was prepared in the same manner as in the embodiment 7 except for the following change.

<Change>

In the preparation of the elastic layer 12, as the rubber material of the elastic layer 12, an addition-curable liquid silicone rubber (trade name: "TSE3032 AB" (weight ratio, A:B=100:20), manufactured by Momentive Performance Materials Inc.) higher in cross-linking point density than the addition-curable liquid silicone rubber used in the embodiment 7 was used.

<Thickness>

As regards the thicknesses of the respective layers of the intermediary transfer belt 1 of the embodiment 14, the base layer 11 was 85 μm, the elastic layer 12 was 220 μm, the intermediary layer 13 was 4.0 and the surface layer 14 was 3.0 μm.

Comparison Embodiment 1

An intermediary transfer belt 1 of a comparison example 1 was prepared, in the same manner as in the embodiment 1 except for the following change.

<Change>

The paint of the intermediary layer 13 was not applied.

<Thickness>

As regards the thicknesses of the respective layers of the intermediary transfer belt 1 of the comparison example 1, the base layer 11 was 85 μm, the elastic layer 12 was 220 μm, and the surface layer 14 was 3.0 μm.

Comparison Example 2

An intermediary transfer belt 1 of a comparison example 2 was prepared, in the same manner as in the embodiment 1 except for the following change.

<Change>

In the preparation of the intermediary layer 13, the ejection amount (rate) of the paint of the intermediary layer 13 during application was set so that the thickness of the intermediary layer 13 after drying was 3 μm.

<Thickness>

As regards the thicknesses of the respective layers of the intermediary transfer belt 1 of the comparison example 2, the base layer 11 was 85 μm, the elastic layer 12 was 220 μm, the intermediary layer 13 was 3.0 μm, and the surface layer 14 was 3.0 μm.

Comparison Example 3

An intermediary transfer belt 1 of a comparison example 3 was prepared in the same manner as in the embodiment 13 except for the following change.

<Change>

In the preparation of the elastic layer 12, as the rubber material of the elastic layer 12, an addition-curable liquid silicone rubber (trade name: "TSE3032 AB" (weight ratio, A:B=1000:1), manufactured by Momentive Performance Materials Inc.) further lower in cross-linking point density than the addition-curable liquid silicone rubber used in the embodiment 13 was used.

<Thickness>

As regards the thicknesses of the respective layers of the intermediary transfer belt 1 of the comparison example 3, the base layer 11 was 85 μm, the elastic layer 12 was 220 μm, the intermediary layer 13 was 4.0 μm, and the surface layer 14 was 3.0 μm.

Comparison Example 4

An intermediary transfer belt 1 of a comparison example 4 was prepared in the same manner as in the embodiment 14 except for the following change.

<Change>

In the preparation of the elastic layer 12, as the rubber material of the elastic layer 12, an addition-curable liquid silicone rubber (trade name: "TSE3032 AB" (weight ratio, A:B=100:30), manufactured by Momentive Performance Materials Inc.) further higher in cross-linking point density than the addition-curable liquid silicone rubber used in the embodiment 14 was used.

<Thickness>

As regards the thicknesses of the respective layers of the intermediary transfer belt 1 of the embodiment 13, the base layer 11 was 85 μm, the elastic layer 12 was 220 μm, the intermediary layer 13 was 4.0 and the surface layer 14 was 3.0 μm.

Kinds of the materials of the intermediary layers 13 and the thicknesses of the respective layers of the prepared intermediary transfer belts 1 of the embodiments 1 to 14 and the comparison examples 1 to 4 are shown in a table 1.

TABLE 1

| | ILM*1 | BLT*2 [μm] | ELT*3 [μm] | ILT*4 [μm] | SLT*5 [μm] |
|---|---|---|---|---|---|
| EMB. 1 | PU | 85 | 220 | 8.0 | 3.0 |
| EMB. 2 | PI | 85 | 220 | 6.0 | 3.0 |
| EMB. 3 | PVC | 85 | 220 | 2.0 | 3.0 |
| EMB. 4 | FR | 85 | 220 | 1.6 | 3.0 |
| EMB. 5 | PR | 85 | 220 | 15.0 | 3.0 |
| EMB. 6 | CA | 85 | 220 | 16.0 | 3.0 |
| EMB. 7 | PU | 85 | 220 | 4.0 | 3.0 |
| EMB. 8 | PI | 85 | 220 | 3.0 | 3.0 |
| EMB. 9 | PVC | 85 | 220 | 1.0 | 3.0 |
| EMB. 10 | FR | 85 | 220 | 0.8 | 3.0 |
| EMB. 11 | PR | 85 | 220 | 7.5 | 3.0 |
| EMB. 12 | CA | 85 | 220 | 8.0 | 3.0 |
| EMB. 13 | PU | 85 | 220 | 4.0 | 3.0 |
| EMB. 14 | PU | 85 | 220 | 4.0 | 3.0 |
| COMP. EX. 1 | — | 85 | 220 | — | 3.0 |
| COMP. EX. 2 | PU | 85 | 220 | 3.0 | 3.0 |
| COMP. EX. 3 | PU | 85 | 220 | 4.0 | 3.0 |
| COMP. EX. 4 | PU | 85 | 220 | 4.0 | 3.0 |

*1"ILM" is an intermediary layer material. "PU" is polyurethane. "PI" is polyamide. "PVC" is polyvinyl chloride. "FR" is fluorine-containing resin. "PR" is phenolic resin. "CA" is cellulose acetate.

*2"BLT" is a base layer thickness.

*3"ELT" is an elastic layer thickness.

*4"ILT" is an intermediary layer thickness.

*5"SLT" is a surface layer thickness.

3-2. Evaluation of Intermediary Transfer Belts of Embodiments and Comparison Examples Next, for each of the intermediary transfer belts 1 of the embodiments and the comparison examples, a result of measurement or evaluation of water vapor permeability coefficient of the intermediary layer 13, JIS-A hardness or JIS-E hardness of the elastic layer 12, bleed, transfer property onto uneven paper, surface resistivity and volume resistivity will be described.

<Measuring Method of Water Vapor Permeability Coefficient>

The water vapor permeability coefficient was measured and evaluated in accordance with JIS Z0208 (testing methods for determination of the water vapor transmission rate (dish method)(test condition: 40° C., 90% RH). Only the intermediary layer 13 of the prepared intermediary transfer belt 1 was removed, and a water vapor transmission rate of the removed intermediary transfer belt 1 was measured. By multiplying this water vapor transmission rate by a thickness of a sample (intermediary layer 13), water vapor permeability coefficient of an object-to-be-evaluated was calculated.

Incidentally, the sample was obtained from a range of an image region (in which the toner image is capable of being transferred onto the surface of the intermediary transfer belt 1) with respect to a widthwise direction of the intermediary transfer belt 1. Specifically, the sample was obtained so as to contain a central position of each object-to-be-evaluated with respect to the widthwise direction of the intermediary transfer belt 1. Further, a measured value of the water vapor permeability coefficient, of each object-to-be-evaluated, as to the intermediary transfer belt 1 can be represented by an average of measured values obtained by a plurality of measurements (for example, at five positions with respect to a circumferential direction of the belt).

<Measuring Methods of JIS-A Hardness and JIS-E Hardness>

Only the elastic layer 12 of the prepared intermediary transfer belt 1 was removed, and a test piece was prepared from the removed elastic layer 12. A size of the test piece is 10 mm×10 mm or more. Further, the test piece was obtained by laminating the removed elastic layer 12 until a thickness was 6.0 mm or more. By using a type-A durometer, hardness of the prepared test piece was measured. This measurement was made five times (for example, at five positions with respect to the circumferential direction of the belt), and a median value of the measured values was taken as JIS-A hardness. As regards the test pieces with the JIS-A hardness of 10 degrees or more, the hardness was measured using a type-E durometer, and the measured value was taken as JIS-E hardness.

Incidentally, the test pieces were obtained from the range of the image region with respect to the widthwise direction of the intermediary transfer belt 1. Specifically, the test pieces were obtained so as to contain the central position of each object-to-be-evaluated with respect to the widthwise direction of the intermediary transfer belt 1.

<Evaluating Method of Bleed>

In place of the intermediary transfer belt mounted in a full-color electrophotographic image forming apparatus (trade name: "Image PRESS C800", manufactured by Canon Inc.), each of the intermediary transfer belts 1 of the embodiments and the comparison examples was mounted. Then, the photosensitive drum 101K of the image forming portion for black was contacted to the intermediary transfer belt 1 as an object-to-be-evaluated for 10 min. in a high-temperature and high-humidity environment (temperature: 30° C., relative humidity: 80% RH). Thereafter, a solid black image (with a maximum density level) was outputted on 100 sheets of A3-size plain paper (trade name: "GF-0081A3", manufactured by Canon Inc.). Incidentally, for image formation, a black developer accommodated in a print cartridge of the above-described electrophotographic image forming apparatus. Further, image output was carried out under a high temperature and high humidity environment (temperature: 30° C., relative humidity: 80% RH).

After the image output, the solid images on the 100 sheets were evaluated in the following procedure. In a region corresponding to a region in which the photosensitive drum 101K for black was contacted to the intermediary transfer belt 1 before the image formation, stripe-shaped image deterioration extending along the widthwise direction due to bleed of the intermediary transfer belt 1 was observed with eyes as to that the image deterioration disappeared in the output image on what number of the 100 sheets. Then, a degrees of bleed was evaluated in the following criteria. This stripe-shaped image deterioration would be considered to generate due to disorder (flow) of the electrostatic (latent) image caused by a fluctuation of an electric resistance of the surface of the photosensitive drum 101K on which a bleed component migrated to the surface of the intermediary transfer belt 1 was deposited. Further, it would be considered that this stripe-shaped image deterioration is improved by removal or the like of the bleed component from the surface of the photosensitive drum 101K through continuation of the image output.

Rank A: The image deterioration disappeared in the output image on 10 sheets or less.

Rank B: The image deterioration disappeared in the output image on 11 sheets or more and 50 sheets or less.

Rank C: The image deterioration disappeared in the output image on 51 sheets or more and 100 sheets or less.

Rank D: The image deterioration did not disappear in the output image on the 100 sheets.

Incidentally, in general, as a preparation operation before the image formation, a press-rotation operation (rotation operation of the photosensitive drum) is performed. For this reason, when the rank is levels A and B, by the pre-rotation operation, the above-described disorder of the electrostatic image is eliminated and thus there is no problem.

<Evaluation Method of Transfer Property onto Uneven Paper>

In place of the intermediary transfer belt mounted in a full-color electrophotographic image forming apparatus (trade name: "Image PRESS C800", manufactured by Canon Inc.), each of the intermediary transfer belts 1 of the embodiments and the comparison examples was mounted. Then, a solid blue image was outputted on sheets of A4-size plain paper (trade name: "CS-814", manufactured by Canon Inc.). Incidentally, for image formation, cyan and magenta developers accommodated in print cartridges of the above-described electrophotographic image forming apparatus. Further, image output was carried out under a normal temperature and normal humidity environment (temperature: 25° C., relative humidity: 55% RH).

Next, a solid image of a secondary color was outputted on A3-size paper ("Rezac 66", 250 g) by using the cyan and magenta developers, and a resultant solid image was evaluated in the following procedure. By using a scanner ("CanoScan 9000F", manufactured by Canon Inc.), the solid image was read under a condition of a reading resolution of 600 dpi and an image correction process: OFF, and then was subjected to trimming in a range of 2,550×2,550 pixels (about 10.8×10.8 cm). The resultant image was observed with eyes at a display magnification of 200%, and then whether or not image non-uniformity due to a magnitude of surface roughness occurred and a degrees of the image non-uniformity in the case where the image non-uniformity occurred were observed. Then, an image quality was evaluated by the following criteria.

Rank A: No image non-uniformity was observed at all and the image quality was good.

Rank B: Slight image non-uniformity was partially observed.

Rank C: The image non-uniformity was observed in a region of about 20% of an observed image.

Rank D: The image non-uniformity was observed in a region over 50% or more of the observed image.

<Measuring Method of Surface Resistivity and Volume Resistivity> measurement of surface resistivity of the intermediary transfer belt 1 was carried out using a circular electrode (trade name: "Hiresta UP", manufactured by Mitsubishi Chemical Analytech Co., Ltd.). The intermediary transfer belt 1 which is an object-to-be-measured is placed on a plate of an Insulative material and a voltage of 1000 V is applied thereto, and then a value after a lapse of 10 sec from the application is read. The measurement is performed at arbitrary 16 positions in a single belt plane, and an average of measured values is taken as the surface resistivity of the intermediary transfer belt 1 which is the object-to-be-measured.

A measuring method of the volume resistivity is substantially the same as the above-described measuring method of the third resistivity except that an object-to-be-measured is placed on a metal plate and then a current flowing between the metal plate and a cylindrical electrode is measured.

In a table 2 appearing hereinafter, for example, $1.0\times10^{11}$ Ω/sq. is represented by 1E+11 Ω/sq., and $1.0\times10^{10}$ Ω·cm is represented by 1E+10 Ω·cm.

<Evaluation Result>

A measurement result or evaluation result of water vapor permeability coefficient of the intermediary layer 13, JIS-A hardness or JIS-E hardness of the elastic layer 12, bleed, transfer property onto uneven paper, surface resistivity and volume resistivity is shown in the table 2.

TABLE 2

| | ILWVPC*1 [g/m².24h] | ELH*2 [deg.] | BL*3 | TR*4 | SR*5 [Ω/sq.] | VR*6 [Ω.cm] |
|---|---|---|---|---|---|---|
| EMB.1 | 100 | JIS-A 27 | A | A | 1E+11 | 1E+10 |
| EMB.2 | 98 | JIS-A 27 | A | A | 1E+11 | 1E+10 |
| EMB.3 | 103 | JIS-A 27 | A | A | 1E+11 | 1E+10 |
| EMB.4 | 108 | JIS-A 27 | A | A | 1E+11 | 1E+10 |
| EMB.5 | 105 | JIS-A 27 | A | A | 1E+11 | 1E+10 |
| EMB.6 | 97 | JIS-A 27 | A | B | 1E+11 | 1E+10 |
| EMB.7 | 595 | JIS-A 27 | A | A | 1E+11 | 1E+10 |
| EMB.8 | 582 | JIS-A 27 | A | A | 1E+11 | 1E+10 |
| EMB.9 | 577 | JIS-A 27 | A | A | 1E+11 | 1E+10 |
| EMB.10 | 590 | JIS-A 27 | B | A | 1E+11 | 1E+10 |
| EMB.11 | 569 | JIS-A 27 | A | A | 1E+11 | 1E+10 |
| EMB.12 | 541 | JIS-A 27 | A | A | 1E+11 | 1E+10 |
| EMB.13 | 598 | JIS-A 1<br>JIS-E 5 | B | A | 1E+11 | 1E+10 |
| EMB.14 | 600 | JIS-A 60 | A | B | 1E+11 | 1E+10 |
| COMP. EX.1 | — | JIS-A 27 | D | A | 1E+11 | 1E+10 |
| COMP. EX.2 | 717 | JIS-A 27 | D | A | 1E+11 | 1E+10 |
| COMP. EX.3 | 591 | JIS-A 1<br>JIS-E 1 | D | A | 1E+11 | 1E+10 |
| COMP. EX.4 | 583 | JIS-A 65 | A | D | 1E+11 | 1E+10 |

*1"ILWVPC" is intermediary layer water vapor permeability coefficient.
*2"ELH" is elastic layer hardness in terms of JIS-A hardness or JIS-E hardness.
*3"BL" is the bleed.
*4"TR" is the transfer property onto the uneven paper.
*5"SR" is the surface resistivity.
*6"VR" is the volume resistivity.

As is understood from the result of the table 2, in the case where the intermediary layer 13 was not provided or in the case where the water vapor permeability coefficient of the intermediary layer 13 was large, the image deterioration due to the bleed occurred (comparison example 1 and comparison example 2). On the other hand, in the case where the intermediary layer 13 with small water vapor permeability coefficient was provided between the elastic layer 12 and the surface layer 14, the image deterioration due to the bleed was suppressed (embodiments 1 to 14). This would be considered because of the following reason. That is, the image deterioration due to the bleed occurs by migration, to the surface of the surface layer 14, of a low-molecular weight component, contained in the elastic layer 12, derived from the silicone rubber which is a main component of the elastic layer 12. On the other hand, by incorporating the intermediary layer 13 with small water vapor permeability coefficient between the elastic layer 12 and the surface layer 14, it is possible to prevent migration of the bleed component, generated from the elastic layer 12, to the surface of the intermediary transfer belt 1. As a result, it would be considered that the image deterioration due to the bleed can be suppressed. As is understood from the result of the table 2, when the water vapor permeability coefficient of the intermediary layer 13 is 600 g/m²·24 h or less, an effect of preventing the migration of the bleed component to the surface of the intermediary transfer belt 1. Further, as is understood from the result of the table 2, in order to achieve a higher effect of preventing the migration of the bleed component to the surface of the intermediary transfer belt 1, the water vapor permeability coefficient of the intermediary layer 13 may preferably be 108 g/m²·24 h or less, more preferably be 100 g/m²·24 h or less. Incidentally, the water vapor permeability coefficient of the intermediary layer 13 is more preferable with a decreasing value, but from a viewpoint of a cost, the intermediary layer water vapor permeability coefficient may preferably be typically 0.1 g/m²·24 h or more at the smallest.

On the other hand, as is understood from the result of the table 2, in the case where the JIS-E hardness of the elastic layer 12 was excessively low, the image deterioration due to the bleed occurred (comparison example 3). This would be considered because in the case where the JIS-E hardness of the elastic layer 12 is excessively low, the bleed component increases due to an increase in intermolecular free volume of the silicone rubber of the elastic layer 12. Further, it would be considered that in the case where the JIS-E hardness of the elastic layer 12 is excessively low, also generation of initial crack of the surface layer 14 due to a difference in hardness between the elastic layer 12 and the surface layer 14 has the influence on the image deterioration. Further, as is understood from the result of the table 2, in the case where the JIS-A hardness of the elastic layer 12 is excessively high, the transfer property onto the uneven paper, which is a function required for an elastic intermediary transfer belt lowers (comparison example 4). This would be considered because followability to the uneven paper lowers and thus the transfer onto the uneven paper lowers. As is understood from the result of the table 2, a transfer property improving effect by the elastic layer 12 can be obtained while the elastic layer 12 is elastically deformed (embodiment 13, embodiment 14). As a result of further study, in order to suppress the image deterioration due to the bleed, it was found that the elastic layer 12 is 55 degrees or less in JIS-A hardness and is 10 degrees or more in JIS-E hardness.

4. Experiment Example 2

4-1. Structures of Intermediary Transfer Belts in Embodiments and Comparison Examples Next, an influence of surface modification of the elastic layer 12 will be described using the following embodiments 21 to 24 and comparison examples 21 to 23. For convenience, in this experiment example, the following embodiments and comparison examples are represented by adding numbers of twenties.

Embodiment 21

An intermediary transfer belt 1 of an embodiment 21 was prepared in the same manner as in the embodiment 1 described in the experiment example 1.

Embodiment 22

An intermediary transfer belt 1 of an embodiment 22 was prepared in the same manner as in the embodiment 21 (embodiment 1) except for the following change.

In the preparation of the elastic layer 12, as the rubber material of the elastic layer 12, an addition-curable liquid silicone rubber (trade name: "TSE3032 AB" (weight ratio, A:B=1000:5), manufactured by Momentive Performance Materials Inc.) lower in cross-linking point density than the addition-curable liquid silicone rubber used in the embodiment 21 was used.

Embodiment 23

An intermediary transfer belt 1 of an embodiment 23 was prepared in the same manner as in the embodiment 21 (embodiment 1) except for the following change.

In the preparation of the elastic layer 12, as the rubber material of the elastic layer 12, an addition-curable liquid silicone rubber (trade name: "TSE3032 AB" (weight ratio, A:B=100:20), manufactured by Momentive Performance Materials Inc.) higher in cross-linking point density than the addition-curable liquid silicone rubber used in the embodiment 21 was used.

Embodiment 24

An intermediary transfer belt 1 of an embodiment 24 was prepared in the same manner as in the embodiment 21 (embodiment 1) except for the following change. In the surface modification, the excimer UV irradiation time was changed to 10 min.

Embodiment 25

An intermediary transfer belt 1 of an embodiment 25 was prepared in the same manner as in the embodiment 21 (embodiment 1) except for the following change. In the surface modification, the excimer UV irradiation time was changed to 60 min.

Comparison Example 21

An intermediary transfer belt 1 of a comparison example 21 was prepared in the same manner as in the embodiment 22 except for the following change.

In the preparation of the elastic layer 12, as the rubber material of the elastic layer 12, an addition-curable liquid silicone rubber (trade name: "TSE3032 A/B" (weight ratio, A:B=1000:1), manufactured by Momentive Performance Materials Inc.) further lower in cross-linking point density than the addition-curable liquid silicone rubber used in the embodiment 22 was used.

Comparison Example 22

An intermediary transfer belt 1 of a comparison example 22 was prepared in the same manner as in the embodiment except for the following change.

In the preparation of the elastic layer 12, as the rubber material of the elastic layer 12, an addition-curable liquid silicone rubber (trade name: "TSE3032 A/B" (weight ratio, A:B=100:30), manufactured by Momentive Performance Materials Inc.) further higher in cross-linking point density than the addition-curable liquid silicone rubber used in the embodiment 21 was used.

Comparison Example 23

An intermediary transfer belt 1 of a comparison example 23 was prepared in the same manner as in the embodiment 21 (embodiment 1) except for the following change. In the surface modification, the excimer UV irradiation time was changed to 90 min.

Thicknesses of the respective layers of the prepared intermediary transfer belts 1 of the embodiments 21-25 and the comparison examples 21-24 and the excimer UV irradiation times of the elastic layer 12 of the prepared intermediary transfer belts 1 are shown in a table 3.

TABLE 3

| | EUVIT*1 [min] | BLT*2 [μm] | ELT*3 [μm] | ILT*4 [μm] | SLT*5 [μm] |
|---|---|---|---|---|---|
| EMB. 21 | 30 | 85 | 220 | 8.0 | 3.0 |
| EMB. 22 | 30 | 85 | 220 | 8.0 | 3.0 |
| EMB. 23 | 30 | 85 | 220 | 8.0 | 3.0 |
| EMB. 24 | 10 | 85 | 220 | 8.0 | 3.0 |
| EMB. 25 | 60 | 85 | 220 | 8.0 | 3.0 |
| COMP. EX. 21 | 30 | 85 | 220 | 8.0 | 3.0 |
| COMP. EX. 22 | 30 | 85 | 220 | 8.0 | 3.0 |
| COMP. EX. 23 | 90 | 85 | 220 | 8.0 | 3.0 |

*1"EUVIT" is the excimer UV irradiation time
*2"BLT" is the base layer thickness.
*3"ELT" is the elastic layer thickness.
*4"ILT" is the intermediary layer thickness.
*5"SLT" is the surface layer thickness.

4-2. Evaluation of Intermediary Transfer Belts of Embodiments and Comparison Examples Next, for each of the intermediary transfer belts 1 of the embodiments and the comparison examples, a result of measurement or evaluation of a surface modification depth of the elastic layer 12, water vapor permeability coefficient of the intermediary layer 13, JIS-A hardness or JIS-E hardness of the elastic layer 12, initial crack of the elastic layer 12, bleed, transfer property onto uneven paper, surface resistivity and volume resistivity will be described. Incidentally, the measuring method of the water vapor permeability coefficient, the measuring method of the JIS-A hardness or the JIS-E hardness, the evaluating method of the bleed, the evaluating method of the transfer property onto the uneven paper, the measuring method of the surface resistivity and the measuring method of the volume resistivity are the same as those in the experiment example 1.

<Evaluating Method of Modification Depth of Elastic Layer>

A modification depth ($SiO_2$ layer thickness) of the silicone rubber formed by surface modification of the elastic layer 12 is calculated. First, the intermediary transfer belt 1 is cut into a shape of about 10 mm×10 mm by a cutter knife or the like, and thereafter is embedded in an epoxy resin material. Then, after the epoxy resin material is curved, a cross-sectional sample is prepared by abrasive paper. Using this cross-sectional sample, a modification depth of the silicone rubber was calculated from an image representing an amount of flexure of a cantilever (a deformation amount of a sample) obtained by an operation in a measuring mode ("Peak Force QNM") using an atomic force microscope (trade name: "Dimension Icon", manufactured by Bruker Corp.) and a cantilever ("Scan Asyst-Air", manufactured by Bruker Corp.).

Specifically, the amount of flexure of the cantilever (the deformation amount of the sample) was measured, and a portion to a position where the flexure amount abruptly changed was taken as a surface modification layer, and a thickness from the surface of the elastic layer to a top end of the surface modification layer was taken as a thickness of the $SiO_2$ layer. Incidentally, identification of the surface modification layer as the $SiO_2$ layer was made by a peak position of X-ray diffraction.

<Evaluating Method of Initial Crack of Elastic Layer>

Whether or not crack occurred was checked by observation, of the surface of the elastic layer 12 after the surface modification, through an optical microscope or the like. Then, the initial crack of the elastic layer 12 by the following criteria.

Rank A: No crack was observed at all (good).

Rank B: Crack of less than 3 μm in width occurred.

Rank C: Crack of 3 μm or more and less than 5 μm in width occurred.

<Evaluation Result>

As regards the intermediary transfer belts 1 of the embodiments and the comparison examples, the measurement result or the valuation result of the modification depth of the elastic layer 12, the water vapor permeability coefficient of the intermediary layer 13, the JIS-A hardness or the JIS-E hardness of the elastic layer 12, the initial crack of the elastic layer 12, the bleed, the transfer property onto the uneven paper, the surface resistivity, and the volume resistivity is shown in Table 4.

TABLE 4

| | MD*1 [μm] | WVPC*2 [g/m$^2$.24h] | ELT*3 [deg] | IC*4 | BLT*5 | TR*6 [Ω/sq.] | SR*7 [Ω.cm] | VR*8 |
|---|---|---|---|---|---|---|---|---|
| EMB.21 | 1.0 | 100 | JIS-A 27 | A | A | A | 1E+11 | 1E+10 |
| EMB.22 | 1.0 | 100 | JIS-A 1<br>JIS-E 5 | A | B | A | 1E+11 | 1E+10 |
| EMB.23 | 1.0 | 100 | JIS-A 60 | A | A | B | 1E+11 | 1E+10 |
| EMB.24 | 0.1 | 100 | JIS-A 27 | A | B | A | 1E+11 | 1E+10 |
| EMB.25 | 2.0 | 100 | JIS-A 27 | B | A | A | 1E+11 | 1E+10 |
| COMP. EX.21 | 1.0 | 100 | JIS-A 1<br>JIS-E 1 | A | D | A | 1E+11 | 1E+10 |
| COMP. EX.22 | 1.0 | 100 | JIS-A 65 | A | A | D | 1E+11 | 1E+10 |
| COMP. EX.23 | 3.0 | 100 | JIS-A 27 | D | A | A | 1E+11 | 1E+10 |

*1"MD" is the modified thickness of the elastic layer.
*2"WVPC" is the water vapor permeability coefficient of the intermediary layer.
*3"ELH" is the elastic layer hardness in terms of the JIS-A hardness or JIS-E hardness.
*4"IC" is the initial crack of the elastic layer.
*5"BL" is the bleed.
*6"TR" is the transfer property onto the uneven paper.
*7"SR" is the surface resistivity.
*8"VR" is the volume resistivity.

As is understood from the result of the table 4, in the case where the modification depth of the elastic layer 12 is large, an effect of suppressing the image deterioration due to the bleed is high (embodiment 21, embodiment 25). This would be considered because of the following reason. That is, the image deterioration due to the bleed occurs by migration, to the surface of the surface layer 14, of a low-molecular weight component, contained in the elastic layer 12, derived from the silicone rubber which is a main component of the elastic layer 12. On the other hand, by the surface modification of the elastic layer 12, the $SiO_2$ layer is formed on the surface of the elastic layer 21 and functions as a bleed preventing layer. For that reason, in combination of this bleed component preventing effect by the $SiO_2$ layer and a bleed component preventing effect by the intermediary layer 13, it would be considered that the effect of suppressing the image deterioration due to the bleed can be enhanced. However, in the case where the modification depth of the elastic layer 12 was excessively large, the initial crack of the elastic layer 12 occurred (comparison example 24). This would be considered because flexibility of the elastic layer 12 was impaired. As is understood from the result of the table 4, the modification depth, i.e., the thickness of the $SiO_2$ layer may preferably be 0.1 μm or more and 2.0 μm or less (embodiment 24, embodiment 25).

Further, similarly as in the embodiment 1, from the result of the table 4, in order to obtain the effect of improving the transfer property by the elastic layer 12 while suppressing the image deterioration due to the bleed, it is understood that there is a need that the JIS-A hardness of the elastic layer 12 is 60 degrees or less and the JIS-E hardness of the elastic layer 12 is 5 degrees or more (embodiment 22, embodiment 23, comparison example 21, comparison example 22).

5. Experiment Example 3

5-1. Structures of Intermediary Transfer Belts in Embodiments and Comparison Examples Next, an influence of a degrees of cross-linking of the material of the elastic layer 12 will be described using the following embodiments 31 to 37 and comparison examples 31 to 34. For convenience, in this experiment example, the following embodiments and comparison examples are represented by adding numbers of thirties.

Embodiment 31

An intermediary transfer belt 1 of an embodiment 31 was prepared in the same manner as in the embodiment 1 described in the experiment example 1.

Embodiment 32

An intermediary transfer belt 1 of an embodiment 32 was prepared in the same manner as in the embodiment 31 (embodiment 1) except for the following change.

In the preparation of the elastic layer 12, as the rubber material of the elastic layer 12, an addition-curable liquid silicone rubber (trade name: "TSE3032 AB" (weight ratio, A:B=1000:5), manufactured by Momentive Performance Materials Inc.) lower in cross-linking point density than the addition-curable liquid silicone rubber used in the embodiment 1 was used.

Embodiment 33

An intermediary transfer belt 1 of an embodiment 33 was prepared in the same manner as in the embodiment 31 (embodiment 1) except for the following change.

In the preparation of the elastic layer 12, as the rubber material of the elastic layer 12, an addition-curable liquid silicone rubber (trade name: "TSE3032 AB" (weight ratio, A:B=100:20), manufactured by Momentive Performance Materials Inc.) higher in cross-linking point density than the addition-curable liquid silicone rubber used in the embodiment 1 was used.

Embodiment 34

An intermediary transfer belt 1 of an embodiment 34 was prepared in the same manner as in the embodiment 31 (embodiment 1) except for the following change. In preparation of the elastic layer 12, after the mixture liquid was applied onto the base layer 11, the belt on which the mixture liquid was applied is placed in the heating furnace in a state in which the belt was mounted on the core, and was heated at 130° C. for 10 min. as primary baking and then was heated at 150° C. for 180 min. as secondary baking, so that rubber cross-linking was carried out.

Embodiment 35

An intermediary transfer belt 1 of an embodiment 35 was prepared in the same manner as in the embodiment 31 (embodiment 1) except for the following change. In preparation of the elastic layer 12, after the mixture liquid was applied onto the base layer 11, the belt on which the mixture liquid was applied is placed in the heating furnace in a state in which the belt was mounted on the core, and was heated at 130° C. for 10 min. as primary baking and then was heated at 210° C. for 180 min. as secondary baking, so that rubber cross-linking was carried out.

Embodiment 36

An intermediary transfer belt 1 of an embodiment 36 was prepared in the same manner as in the embodiment 34 except for the following change. In preparation of the intermediary layer 13, the ejection amount of the paint for the intermediary layer 13 during application was set so that the thickness of the intermediary layer 13 after drying was 4 μm.

Embodiment 37

An intermediary transfer belt 1 of an embodiment 37 was prepared in the same manner as in the embodiment 35 except for the following change. In preparation of the intermediary layer 13, the ejection amount of the paint for the intermediary layer 13 during application was set so that the thickness of the intermediary layer 13 after drying was 4 μm.

Comparison Example 31

An intermediary transfer belt 1 of a comparison example 21 was prepared in the same manner as in the embodiment 31 (embodiment 1) except for the following change.

In the preparation of the elastic layer 12, as the rubber material of the elastic layer 12, an addition-curable liquid silicone rubber (trade name: "TSE3032 A/B" (weight ratio, A:B=1000:1), manufactured by Momentive Performance Materials Inc.) lower in cross-linking point density than the addition-curable liquid silicone rubber used in the embodiment 31 was used.

Further, in preparation of the intermediary layer 13, the ejection amount of the paint for the intermediary layer 13 during application was set so that the thickness of the intermediary layer 13 after drying was 4 μm.

Comparison Example 32

An intermediary transfer belt 1 of a comparison example 32 was prepared in the same manner as in the embodiment 31 (embodiment 1) except for the following change.

In the preparation of the elastic layer 12, as the rubber material of the elastic layer 12, an addition-curable liquid silicone rubber (trade name: "TSE3032 A/B" (weight ratio, A:B=100:30), manufactured by Momentive Performance Materials Inc.) higher in cross-linking point density than the addition-curable liquid silicone rubber used in the embodiment 21 was used.

Further, in preparation of the intermediary layer 13, the ejection amount of the paint for the intermediary layer 13 during application was set so that the thickness of the intermediary layer 13 after drying was 4 μm.

Comparison Example 33

An intermediary transfer belt 1 of a comparison example 33 was prepared in the same manner as in the embodiment 36 except for the following change. In preparation of the elastic layer 12, after the mixture liquid was applied onto the base layer 11, the belt on which the mixture liquid was applied was placed in the heating furnace in a state in which the belt was mounted on the core, and was heated at 130° C. for 10 min. as primary baking and was heated at 210° C. for 120 min. as secondary baking.

Comparison Example 34

An intermediary transfer belt 1 of a comparison example 34 was prepared in the same manner as in the embodiment 37 except for the following change. In preparation of the elastic layer 12, after the mixture liquid was applied onto the base layer 11, the belt on which the mixture liquid was applied was placed in the heating furnace in a state in which the belt was mounted on the core, and was heated at 130° C. for 10 min. as primary baking and was heated at 210° C. for 240 min. as secondary baking.

Thicknesses of the respective layers of the prepared intermediary transfer belts 1 of the embodiments 31-37 and the comparison examples 31-44 and the secondary baking condition in the cross-linking step of the elastic layer 12 of the prepared intermediary transfer belts 1 are shown in a table 5.

TABLE 5

| | T&T*1 | BLT*2 [μm] | ELT*3 [μm] | ILT*4 [μm] | SLT*5 [μm] |
|---|---|---|---|---|---|
| EMB. 31 | 180° C., 180 min. | 85 | 220 | 8.0 | 3.0 |
| EMB. 32 | 180° C., 180 min. | 85 | 220 | 8.0 | 3.0 |
| EMB. 33 | 180° C., 180 min. | 85 | 220 | 8.0 | 3.0 |
| EMB. 34 | 150° C., 180 min. | 85 | 220 | 8.0 | 3.0 |
| EMB. 35 | 210° C., 180 min. | 85 | 220 | 8.0 | 3.0 |
| EMB. 36 | 150° C., 180 min. | 85 | 220 | 4.0 | 3.0 |
| EMB. 37 | 210° C., 180 min. | 85 | 220 | 4.0 | 3.0 |
| COMP. EX. 31 | 180° C., 180 min. | 85 | 220 | 4.0 | 3.0 |

TABLE 5-continued

| | T&T*1 | BLT*2 [μm] | ELT*3 [μm] | ILT*4 [μm] | SLT*5 [μm] |
|---|---|---|---|---|---|
| COMP. EX. 32 | 180° C., 180 min. | 85 | 220 | 4.0 | 3.0 |
| COMP. EX. 33 | 210° C., 120 min. | 85 | 220 | 4.0 | 3.0 |
| COMP. EX. 34 | 210° C., 240 min. | 85 | 220 | 4.0 | 3.0 |

*1"T&T" is the temperature and the time of the secondary baking of the elastic layer.
*2"BLT" is the base layer thickness.
*3"ELT" is the elastic layer thickness.
*4"ILT" is the intermediary layer thickness.
*5"SLT" is the surface layer thickness.

5-2. Evaluation of Intermediary Transfer Belts of Embodiments and Comparison Examples Next, for each of the intermediary transfer belts 1 of the embodiments and the comparison examples, a result of measurement or evaluation of water vapor permeability coefficient of the intermediary layer 13, JIS-A hardness or JIS-E hardness of the elastic layer 12, a degrees of swelling of the elastic layer 12, bleed, transfer property onto uneven paper, surface resistivity and volume resistivity will be described. Incidentally, the measuring method of the water vapor permeability coefficient, the measuring method of the JIS-A hardness or the JIS-E hardness, the evaluating method of the bleed, the evaluating method of the transfer property onto the uneven paper, the measuring method of the surface resistivity and the measuring method of the volume resistivity are the same as those in the experiment example 1.

<Measuring Method of Degrees of Swelling of Elastic Layer.

The degrees of swelling of the elastic layer 12 was measured using the following method in which the degrees of swelling was estimated. That is, a "toluene swelling method" in which a test piece cut from a rubber product was immersed in toluene at room temperature for a certain time, and then a degrees of swelling (volume change rate=(volume after immersion)/(volume before immersion) of the test piece before and after immersion was compared was used.

The measurement of the volume was performed in accordance with JIS K 6258:2016. Further, the test piece was obtained by removing only the elastic layer 12 from the intermediary transfer belt 1 so as to have a shape of 10±0.1 cm in length and width and 0.02±0.005 cm in thickness. Further, in order to set an immersion time at a time in which the volume after the immersion is roughly saturated, the measurement was performed every 24 hours, so that the above-described volume charge rate was obtained. Then, the volume change rate was compared with the volume change rate obtained before 24 hours, and in the case where a difference therebetween was within 5%, the finally obtained volume change rate was taken as a measured value of the degrees of swelling.

Incidentally, the test piece was obtained from the range of the image region of the intermediary transfer belt 1 with respect to the widthwise direction of the intermediary transfer belt 1. Specifically, the test piece was obtained so as to include a central position of each of objects-to-be-measured with respect to the widthwise direction of the intermediary transfer belt 1. Further, the measured value of the degrees of swelling of the elastic layer 12 for the intermediary transfer belt 1 which is each of the objects-to-be-measured can be represented by an average of measured values obtained by performing a plurality of times (for example, fine positions with respect to the circumferential direction of the belt) of the measurement.

<Evaluation Result>

As regards the intermediary transfer belts 1 of the embodiments and the comparison examples, the measurement result or the valuation result of the water vapor permeability coefficient of the intermediary layer 13, the JIS-A hardness or the JIS-E hardness of the elastic layer 12, the degrees of swelling of the elastic layer 12, the bleed, the transfer property onto the uneven paper, the surface resistivity, and the volume resistivity is shown in Table 6.

TABLE 6

| | WVPC*1 [g/m².24h] | ELH*2 [deg.] | DOS*3 [%] | BL*4 | TR*5 | SR*6 [Ω/sq.] | VR*7 [Ω.cm] |
|---|---|---|---|---|---|---|---|
| EMB.31 | 100 | JIS-A 27 | 145 | A | A | 1E+11 | 1E+10 |
| EMB.32 | 100 | JIS-A 1<br>JIS-E 5 | 145 | B | A | 1E+11 | 1E+10 |
| EMB.33 | 100 | JIS-A 60 | 145 | A | B | 1E+11 | 1E+10 |
| EMB.34 | 108 | JIS-A 22 | 160 | A | A | 1E+11 | 1E+10 |
| EMB.35 | 105 | JIS-A 32 | 130 | A | A | 1E+11 | 1E+10 |
| EMB.36 | 595 | JIS-A 22 | 160 | B | A | 1E+11 | 1E+10 |
| EMB.37 | 582 | JIS-A 32 | 130 | B | A | 1E+11 | 1E+10 |
| COMP. EX.31 | 591 | JIS-A 1<br>JIS-E 1 | 145 | D | A | 1E+11 | 1E+10 |
| COMP. EX.32 | 583 | JIS-A 65 | 145 | A | D | 1E+11 | 1E+10 |
| COMP. E.33 | 590 | JIS-A 1<br>JIS-E 3 | 170 | D | A | 1E+11 | 1E+10 |
| COMP. EX.34 | 569 | 37 | 120 | D | A | 1E+11 | 1E+10 |

*1"WVPC" is the water vapor permeability coefficient of the intermediary layer.
*2"ELH" is the elastic layer hardness in terms of JIS-A hardness or JIS-E hardness.
*3"DOS" is the degrees of swelling.
*4"BL" is the bleed.
*5"TR" is the transfer property onto the uneven paper.
*6"SR" is the surface resistivity.
*7"VR" is the volume resistivity.

As is understood from a result of the table 6, in the case where the degrees of swelling of the elastic layer 12 was excessively high, i.e., in the case where a degrees of cross-linking of the silicone rubber was excessively low, even when the intermediary layer 13 was incorporated, the image deterioration due to the bleed occurred (comparison example 33). This would be considered because when the time of the secondary baking of the elastic layer 12 was excessively short and the degrees of cross-linking of the silicone rubber was excessively low, an intermolecular free volume of the silicone rubber of the elastic layer 12 increased and therefore the bleed component increased. On the other hand, even in the case where the degrees of swelling was excessively low, i.e., in the case where the degrees of cross-linking of the silicone rubber was excessively high, the image deterioration due to the bleed occurred (comparison example 34). This would be considered because the time of the secondary baking of the elastic layer 12 was excessively long, a decomposition product by heating increased and acted as a bled product. As is understood from the result of the table 4, the degrees of swelling may preferably be 130% or more and 160% or less (embodiment 31, embodiments 33-37).

Further, similarly as in the embodiment 1, from the result of the table 6, in order to obtain the effect of improving the transfer property by the elastic layer 12 while suppressing the image deterioration due to the bleed, it is understood that there is a need that the JIS-A hardness of the elastic layer 12 is 60 degrees or less and the JIS-E hardness of the elastic layer 12 is 5 degrees or more (embodiment 32, embodiment 33, comparison example 31, comparison example 32).

According to the present invention, it is possible to provide an intermediary transfer belt capable of suppressing the bleed of the component contained in the elastic layer formed using the silicone rubber as the elastic material and to provide the image forming apparatus including the intermediary transfer belt.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-238948 filed on Dec. 20, 2018, which is hereby incorporated by reference herein in its entirety.

What is claimed is:

1. An intermediary transfer belt comprising:

a base layer;

an elastic layer provided on or above said base layer and formed with a silicone rubber as an elastic member;

an intermediary layer provided on or above said elastic layer; and a surface layer provided on or above said intermediary layer, wherein said elastic layer is 60 degrees or less in JIS-A hardness and is 5 degrees or more in JIS-E hardness, and wherein said intermediary layer is 0.1 $g/m^2 \cdot 24$ h or more and 600 $g/m^2 \cdot 24$ h or less in water vapor permeability coefficient and is 1 μm or more and 15 μm or less in average thickness.

2. An intermediary transfer belt according to claim 1, wherein said intermediary layer is 100 $g/m^2 \cdot 24$ h or less in water vapor permeability coefficient.

3. An intermediary transfer belt according to claim 1, wherein said intermediary layer is formed of urethane resin material, polyamide resin material, polyvinylidene chloride resin material, fluorine-containing resin material or cellulose acetate resin material.

4. An intermediary transfer belt according to claim 1, further comprising a $SiO_2$ layer provided between said elastic layer and said intermediary layer.

5. An intermediary transfer belt according to claim 4, wherein said $SiO_2$ layer is 0.1 μm or more and 2.0 μm or less in average thickness.

6. An intermediary transfer belt according to claim 1, further comprising a surface modifying layer formed by subjecting said elastic layer to excimer ultraviolet irradiation.

7. An intermediary transfer belt according to claim 6, wherein said surface modifying layer is 0.1 μm or more and 2.0 μm or less in average thickness.

8. An intermediary transfer belt according to claim 1, wherein said elastic layer is 130% or more and 160% or less in degree of swelling as measured by a toluene swelling method.

9. An intermediary transfer belt according to claim 1, wherein said elastic layer contains an ion conductive agent.

10. An intermediary transfer belt according to claim 1, which is 100 μm or more and 1000 μm or less in thickness.

11. An intermediary transfer belt according to claim 1, which is $1.0 \times 10^8$ Ω·cm or more and $1.0 \times 10^{13}$ Ω·cm in volume resistivity.

12. An intermediary transfer belt according to claim 1, which is $1.0 \times 10^9$ Ω/square or more and $1.0 \times 10^{13}$ Ω/square or less in surface resistivity as measured from said surface layer side.

13. An image forming apparatus comprising:

an image forming portion; and an intermediary transfer belt according to claim 1.

* * * * *